United States Patent [19]

Pemberton

[11] 4,279,409

[45] Jul. 21, 1981

[54] PROCESS OF MAKING SIGNATURES FROM PREPRINTED WEBS FOR THE MANUFACTURE OF MAGAZINES OR THE LIKE

[76] Inventor: Bernard E. Pemberton, 8841 N. Westland Dr., Gaithesburg, Md. 20760

[21] Appl. No.: 160,730

[22] Filed: Jun. 18, 1980

[51] Int. Cl.[3] ..... B41F 13/58; B65H 39/02

[52] U.S. Cl. ..... 270/5; 270/8; 270/32; 270/41; 270/54

[58] Field of Search ..... 270/5–9, 270/21, 32, 47–50, 54–56, 42, 63–65, 70–77, 86

[56] References Cited

U.S. PATENT DOCUMENTS

| | | | |
|---|---|---|---|
| Re. 25,870 | 10/1965 | McCain | 270/54 |
| 2,361,140 | 10/1944 | Wolf | 270/5 |
| 2,617,647 | 11/1952 | Davis | 270/59 |
| 2,873,112 | 2/1959 | Crafts | 270/12 |
| 2,873,113 | 2/1959 | McWhorter | 270/12 |
| 2,908,494 | 10/1959 | Brodie | 270/86 |
| 3,162,434 | 12/1964 | Hepp | 270/57 |
| 3,441,267 | 4/1969 | Carstens | 270/45 |
| 3,915,445 | 10/1975 | Duncan | 270/37 |
| 3,966,185 | 6/1976 | McCain | 270/54 |
| 4,046,366 | 9/1977 | McCain | 270/54 |
| 4,050,686 | 9/1977 | McCain | 270/54 |
| 4,162,066 | 7/1979 | McCain | 270/54 |
| 4,179,107 | 12/1979 | Harris | 270/32 |

*Primary Examiner*—Edgar S. Burr
*Assistant Examiner*—A. Heinz

[57] ABSTRACT

Signatures for the manufacture of magazines, and the like, are made from preprinted webs of widths smaller than are used conventionally, with no reduction in the size of the pages of the magazine comprising the signature. The reduction in web width is accomplished by eliminating unnecessary laps on certain of the sheets comprising the signature.

13 Claims, 7 Drawing Figures

86
88
90
92
96
94
94
98
84
94
98
96
100

104
100
102
100
104
106
102
104
100
102

108
106
100
100
112
114
116
118
110
106
108
110
100

PROCESS OF MAKING SIGNATURES FROM PREPRINTED WEBS FOR THE MANUFACTURE OF MAGAZINES OR THE LIKE

FIELD OF THE INVENTION

This invention relates to the manufacture of magazines, books, and the like from a plurality of signatures printed on web press machinery. More particularly, the invention relates to the manufacture of signatures from preprinted webs of widths smaller than are used conventionally, with no reduction in the size of the magazine comprising the signatures.

BACKGROUND OF THE INVENTION

Signatures of 16 pages, and 4 page increments, conventionally are prepared from preprinted webs having four rows of equal width of areas of printed material corresponding to separate pages of the magazine. The lateral edges of the web are extended beyond the outer edges of the outermost or side rows for a distance of from about 5/16" to about ⅜" in order to form a bindery lap or lip, sometimes called a lap margin, along one edge of each sheet which makes up a signature after the web has been folded to make the same. The bindery laps are necessary and used for opening the signatures for inserting them, one within another, in the binding process, although such laps are cut off subsequently in the final trimming operation on the magazine. The cutting off of such laps in the trimming operation results in a wastage of paper.

One type of 16 page signature is made from two preprinted webs which are slit into two ribbons of equal width. The four ribbons are then superposed with proper collation and folded about a longitudinal fold line, offset from the center line of the ribbon so that the extended margin along one side of each ribbon will form the bindery lap of the resulting signature. The signatures are formed by laterally severing or cutting the superposed ribbons, either before or after the folding operation, into segments of a size slightly larger than a page of the magazine.

Another type of 16 page signature, called a catalog or chopper signature, is made from a single preprinted web which is first folded about a longitudinal center line and then laterally severed or cut either before or after the first folding operation into segments of a length slightly greater than twice the height of a page of the magazine. Each segment is then folded again about its lateral center line, and then again about a fold line offset from the longitudinal center line of the twice folded segment so that the extended margins of the web will form a bindery lap along one edge of each sheet making up the final signature. After the signatures are assembled the final trimming operation removes the first and second connecting folds, as well as the bindery laps.

In both types of signatures, however, there is a considerable wastage of paper in providing bindery laps along one edge of all the sheets making up the signatures, which laps are ultimately trimmed off.

SUMMARY OF THE INVENTION

As mentioned above, signatures conventionally are prepared with bindery laps along one edge of each of the sheets. For the binding operation, however, it is unnecessary for the intermediate sheets of a signature to have bindery laps. It is necessary to have bindery laps on only the outermost and innermost sheets of a signature. With this in mind, it has been found that a 16 page signature can be made from preprinted webs of smaller width than is conventional for making a magazine with pages of a given width, the width reduction of the webs being roughly equal to the width of a conventional bindery lap, i.e., about 5/16" to about ⅜". The result is a saving of paper in making a magazine of a given size.

Hence, it is an object of this invention to provide an improved method for making magazine signatures from preprinted webs which makes possible the use of narrower webs with a consequent saving of paper.

Other objects and advantages of the invention will become evident from the following description and accompanying drawings in which:

DETAILED DESCRIPTION OF THE INVENTION

Figures 1, 2, 3:
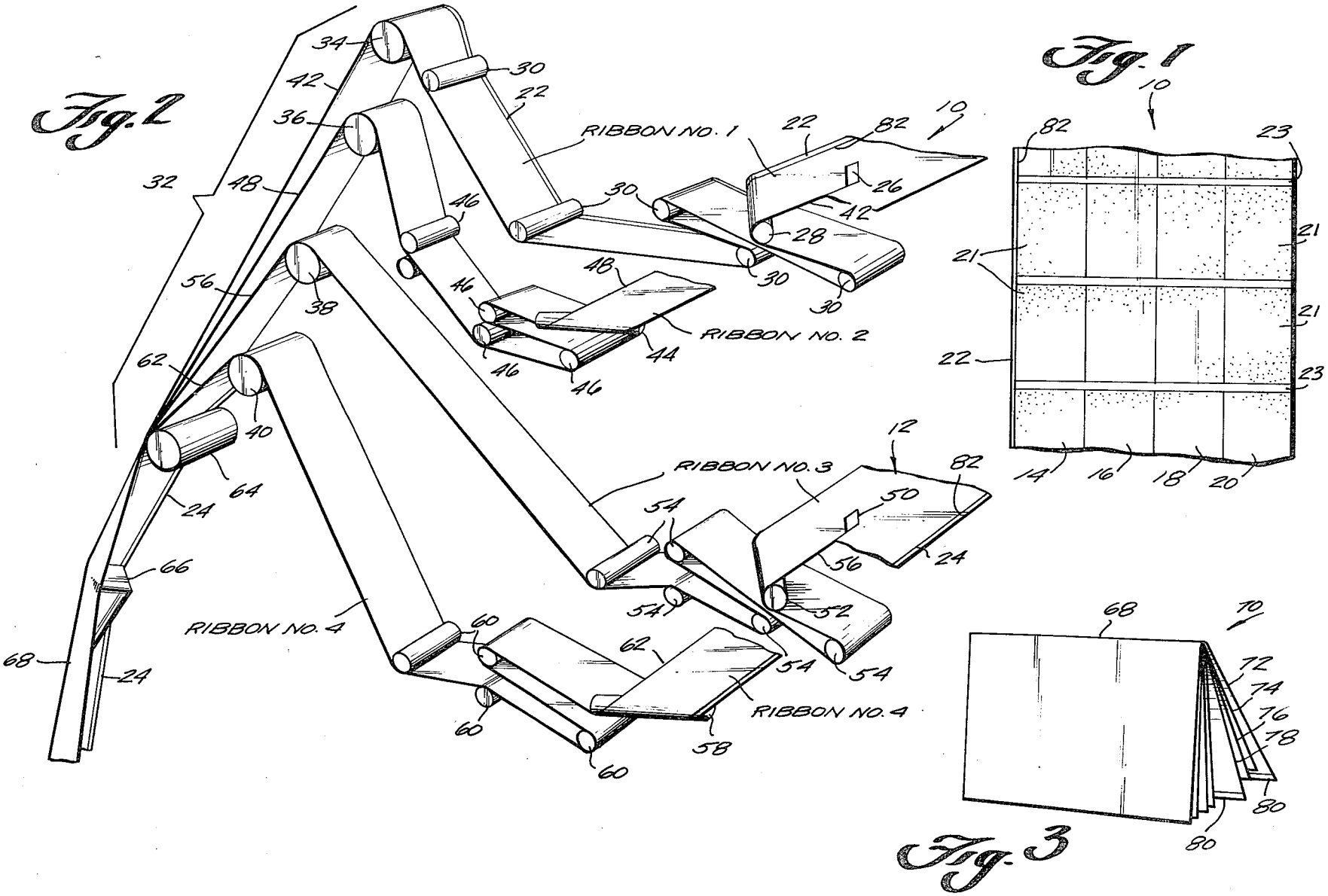
FIG. 1 is a plan view of a preprinted web for forming one type of signature embodying this invention.
FIG. 2 is a schematic perspective view illustrating a process embodying this invention for forming a signature from the web shown in FIG. 1.
FIG. 3 is a perspective view of a signature formed by the process illustrated in FIG. 2.

Referring now to FIGS. 1 and 2 of the drawings, there is illustrated a signature forming process which makes use of two preprinted webs 10 and 12 each including four side-by-side equal-width contiguous longitudinal rows 14, 16, 18 and 20 of separate rectangular areas 21 of equal size containing printed material on their opposite faces. The areas 21 in each row 14, 16, 18 and 20 correspond to separate pages of the magazine to be manufactured. The areas 21 are also arranged in lateral rows spaced longitudinally apart a small distance, as at 23, where the webs 10 and 12 are to be severed laterally. The separate areas 21 are defined in FIG. 1 by boundary lines for illustrative purposes only. In active practice such lines normally are not printed on the webs.

The outer side edge of the right hand row 20 of the upper web 10 and the outer side edge of the left hand row 14 of the lower web 12 are contiguous with the corresponding edges of the webs. Each of the other edges of the webs 10 and 12 have marginal edge portions 22 and 24, respectively, which extend beyond the outer edges of the rows 14 and 20, respectively. These extended marginal edge portions 22 and 24 are substantially equal in width to that of a conventional bindery lap, e.g., 5/16" to ⅜".

The upper web 10 is led generally horizontally past a slitter 26 which slits the web midway of the four rows, i.e., midway between the two intermediate rows 16 and 18, into two ribbons identified as ribbons Nos. 1 and 2.

Ribbon No. 1 on the left hand side is wider than ribbon No. 2 by the width of the marginal edge portion 22. After being slit, ribbon No. 1 is led over a turning or angled roller or bar 28 so as to be moving at approximately right angles to the path of travel of the web 10, and thence over various rollers 30 to a stacking or ribbon superposing station 32 having four spaced parallel rollers 34, 36, 38 and 40. Ribbon No. 1 is led over the top roller 34 with its slit edge 42 adjacent the left hand end of the roller 34. After being slit from the web 10, the narrower ribbon No. 2 is led over a turning roller or bar 44 so as to travel in generally the same direction as ribbon No. 1 and thence over a number of rollers 46 to the second roller 36 at the stacking station 32, with the slit edge 48 of ribbon No. 2 aligned with the slit edge 42 of ribbon No. 1.

The bottom web 12 also is led past a slitter 50 which slits it midway between the two intermediate rows 16 and 18 into ribbons Nos. 3 and 4. Ribbon No. 3 is led over a turning roller or bar 52 and other rollers 54 into a path extending generally in the same direction as ribbon No. 1 and thence over the third roller 38 in the stacking station 32 with the slit edge of the ribbon aligned with the slit edges 42 and 48 of ribbons Nos. 1 and 2. Ribbon No. 4 is led over a turning roller or bar 58 and other rollers 60 similar to those employed for ribbon No. 2 and thence over the fourth roller 40 in the stacking station 32 with its slit edge 62 aligned with the slit edges 42, 48 and 56 of ribbons Nos. 1–3.

All of the ribbons are then led from the four rollers 24, 36, 38 and 40 of the stacking station 32 to a superposing roller 64 where the four ribbons are superposed or stacked with their slit edges 42, 48, 56 and 62 in alignment. The superposed ribbons preferably are then led over a former 66 which folds the ribbons about a longitudinal fold line 68 midway between the two intermediate rows 16 and 18 of areas 21 of material printed on each surface of each ribbon. In this folding process, it will be seen that the extended marginal edge portions 22 and 24 of the outer ribbons Nos. 1 and 4 extend beyond the corresponding edges of the intermediate ribbons Nos. 2 and 3.

The folded ribbons are then cut conventionally along the spacing areas 23 into segments each roughly the size of the leaf of the magazine being made to form what is known in the trade as a "16 page signature" 70 which has bindery laps 80 formed by the extended marginal edge portions 22 and 24 along one edge of only the outermost 72 and innermost 78 of the four sheets 72, 74, 76 and 78 making up the signature. The movements of the webs 10 and 12 and the ribbons Nos. 1–4 are collated so that the separate areas 21 or pages of printed material in each signature will be in appropriate registry. A plurality of such signatures 70 are then accumulated and inserted one into another in a conventional binding process, during which the bindery laps 80 are used to open each signature for the inserting process. The separate signatures 70 are then bound together along their fold lines 68 to form the magazine or the like (not shown), after which the edges of the sheets are trimmed conventionally slightly (e.g. $\frac{1}{8}''$) top and bottom, and along their unbound side edges to remove the bindery laps 80.

Preferably, the invention is practiced with a former 66 as described above. It will be seen, however, that the invention can be practiced with the same papersaving results by severing the superposed ribbons into segments prior to folding and subsequently conventionally folding the segments to form a signature 70.

In conventional machinery for forming signatures from slitted preprinted webs, the several ribbons are of equal width so that there is no problem in achieving lateral registry at the stacking or superposing station. Since ribbons Nos. 1 and 4 according to this invention are of equal width but wider than equal width ribbons Nos. 2 and 3, it is desirable to facilitate proper alignment of all the ribbons at the stacking station 32. This is easily accomplished by printing the webs 10 and 12 with register lines or other indicia 82 to mark the innermost edge of the aforedescribed marginal edge portions 22 and 24. This registering indicia 82 is used at the stacking station to appropriately register ribbons Nos. 2 and 3 with ribbons Nos. 1 and 4 at the right hand side of the rollers 34, 36, 38, 40 and 64.

In making a magazine, for example, of a page size of approximately $8'' \times 11''$, each web 10 and 12 would be approximately $32\frac{7}{8}''$ in width, so as to include four side-by-side rows of areas of printed material, each of a width of $8\frac{1}{8}''$ (to allow for $\frac{1}{8}''$ trim from the side edge of each leaf of the magazine), with the web having an extended marginal edge portion along one of the outer of the rows of $\frac{3}{8}''$ to provide a bindery lap for the signature. In contrast, in a conventional arrangement, where each web has extended marginal portions along both edges, each web would be $33\frac{1}{4}''$ wide so that the paper savings in accordance with this invention would be of the order of 1%. In magazines of smaller page width, it will be seen that the savings would be even larger.

The above process has been described as being practiced with webs having four rows of separate areas 21. It will be seen, however, that it can be practiced with two webs having more than four rows in two row increments, i.e., 6, 8, etc. rows, with an extended marginal edge portion along only one edge. The two webs would each be slit into two-row ribbons which would be appropriately stacked, folded and severed to form 20, 24, etc. page signatures having bindery laps along only one edge of the innermost and outermost sheets making up the signature.

Referring now to FIGS. 4 to 7 of the drawings, there is illustrated a process embodying this invention for making a catalog or chopper signature from a single preprinted web. The web 84, like webs 10 and 12, has four side-by-side equal width contiguous rows 86, 88, 90 and 92 of separate areas 94 containing printed material. At its left hand side the web 84 has an extended marginal edge portion 96 substantially equal in width to that of a conventional bindery lap. The lateral rows of the areas 94 are arranged in pairs having substantially no spacing between the rows of each pair but with the pairs being spaced a small distance apart, as at 98, where the web 40 will be severed laterally into segments. This is in contrast to the spacing between the lateral rows of areas 21 in the webs 10 and 12 wherein all the lateral rows are spaced an appreciable distance from each other.

Figures 4, 5, 6, 7:
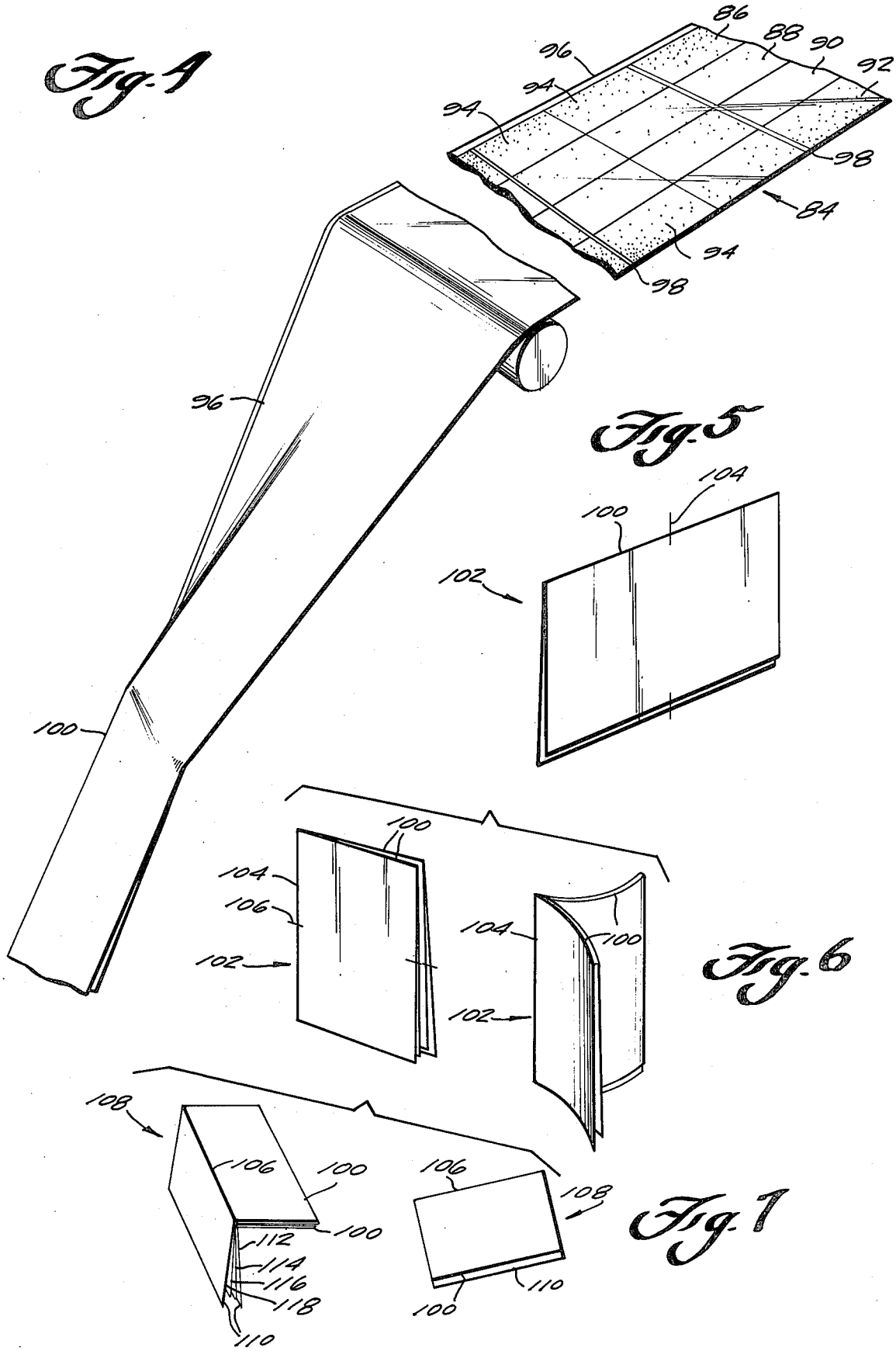
FIG. 4 is a schematic perspective view illustrating the first stage of a process embodying this invention for forming a signature from another type of preprinted web.
FIG. 5 is a perspective view of a segment severed from the folded web shown in FIG. 4.
FIG. 6 includes two perspective views of the segment shown in FIG. 5 after being folded, one showing the segment closed and the other partly open.
FIG. 7 includes two perspective views of a signature formed from the segment shown in FIG. 6, one showing the signature partly open and the other closed.

The advancing web 84 is first folded about a longitudinal fold line 100 midway between the two intermediate rows 88 and 90 of areas 94. The web is next severed or cut laterally substantially midway between adjacent pairs of areas, i.e., in the spacing areas 98, to form segments 102, as shown in FIG. 5, each containing 16 areas or pages 94 and with an overlap of one edge beyond the other, opposite the fold line 100, a distance equal to the width of the extended marginal edge portion 96. The severing operation may take place before the folding operation. Each segment 102 is then folded, as by a conventional tucker (not shown), about a lateral fold line 104 midway between the longitudinal length of the segment, i.e., midway between the two lateral rows of areas 94 in the segment, as shown in FIG. 6. The thus twice folded segment 102 is again folded along a longitudinal fold line 106, parallel to the line 100, midway between the intermediate 88 and 90 and outer 86 and 92 rows of the segment 102 to form a 16 page signature 108 having bindery laps 110 along only one edge of the innermost 112 and outermost 118 of the four sheets making up the folded signature, as shown in FIG. 7. Thereafter a number of signatures 108 are collected and inserted one within the other in collated arrangement to form the magazine (not shown). The final assembly is then trimmed to remove the binery laps 110 and also the first and second folds 100 and 104 which connect all the sheets of the signature 108 at one end and those sheets of the signature along side edges opposite the bindery laps 110.

It thus will be seen that the objects and advantages of this invention have been fully and effectively achieved. It will be realized, however, that the foregoing specific embodiments have been disclosed only for the purpose of illustrating the principles of this invention and is susceptible of modification without departing from such principles. Accordingly, the invention includes all embodiments encompassed within the spirit and scope of the following claims.

I claim:

1. In the method of making magazines or the like of the type comprising at least one folded signature of at least sixteen pages, the steps comprising:

providing at least two preprinted webs each having at least four side-by-side equal width contiguous rows of separate areas of printed material on both web surfaces with the material in each row corresponding to separate pages of the magazine, the outer side edge of one of the outer rows being substantially contiguous with one side edge of the web, and the other side edge of the web being provided with a marginal edge portion extending laterally beyond the outer side edge of the other outer row a distance substantially equal to the amount necessary to form a bindery lap;

superposing said outer rows of each web so that the marginal edge portion of each web extends laterally beyond said one side edge of the web;

superposing the two row-superposed webs so that the marginal edge portions of the two webs are superposed and are outermost; and folding the superposed webs along fold lines intermediate each outer row and the inner row adjacent thereto whereby the folded webs can be laterally severed into signatures each composed of a plurality of folded sheets nested one within the other with one of the sheets being the outermost sheet and all remaining sheets being nested within the outermost sheet, each signature having at least eight leaves and at least sixteen pages and having a bindery lap along one edge of the innermost and the outermost of the sheets making up each signature and with no bindery laps on the corresponding edge of the intermediate sheets.

2. The process defined in claim 1 in which the row-superposing step includes longitudinally slitting the web midway between the two inner rows into two ribbons of unequal width.

3. The process defined in claim 2 in which the row-superposing step includes aligning the slit edges of the four ribbons with the two narrower ribbons between the two wider ribbons.

4. The process defined in claim 3 including the step, prior to the folding step and subsequent to the superposing steps, of laterally severing the webs into segments of a length approximately the height of a leaf in the magazine being made.

5. The process defined in claim 1 including the step of laterally severing the folded web into signatures.

6. The process defined in claim 1 in which the row-superposing step includes folding the web along a longitudinal fold line midway between the two inner rows.

7. The process defined in claim 1 including the step, prior to the providing step of printing register marks on at least one surface of each web coincident with the inner edge of the extended marginal edge portion.

8. In the method of making magazines or the like of the type comprising at least one folded signature of at least sixteen pages, the steps comprising:

slitting two preprinted webs of equal width each into two ribbons of unequal width, the difference in ribbon width being substantially equal to the amount necessary to provide a bindery lap for a folded signature;

superposing the four ribbons with their slit edges in alignment and with the two narrower ribbons between the two wider ribbons;

longitudinally folding the superposed ribbons along a fold line parallel to the slit edges of the ribbons and midway of the width of the narrower ribbons;

and severing the folded ribbons to produce folded signatures each composed of a plurality of folded sheets nested one within the other with one of the sheets being the outermost sheet and all of the remaining sheets being nested within the outermost sheet, each signature having bindery laps on only the outermost and innermost of the sheets making up the signature.

9. The method defined in claim 8 including the step, prior to the slitting step, of printing register marks on each web parallel to that edge thereof which will form a part of the wider ribbon and spaced from such edge a distance substantially equal to the amount necessary to provide a bindery lap.

10. In the method of making magazines or the like of the type comprising at least one folded signature of at least sixteen pages, the steps comprising:

folding a preprinted web about a longitudinal fold line offset from the longitudinal center line of the web a distance substantially equal to the amount necessary to provide a bindery lap for a folded signature;

transversely severing the web into segments each of a length substantially equal to twice the height of a leaf in the magazine being made;

folding each folded segment about a fold line transverse to said longitudinal fold line and substantially midway of the length of the segment; and folding the twice folded segment about a longitudinal fold line to form a 16 page signature having bindery laps on the free edge of only the innermost and outermost sheets.

11. The method defined in claim 10 wherein the first longitudinal folding step takes place prior to the severing operation.

12. The method defined in claim 11 including the step, prior to the first folding step, of printing register marks on the web parallel to that edge thereof which will form a part of the bindery lap and spaced from such edge a distance substantially equal to the amount necessary to provide a bindery lap.

13. A signature comprising:

at least four sheets each folded along a fold line and nested one within the other to superpose said fold lines, said sheets having opposite side edges parallel to said fold line with the side edges of said sheets being in alignment along one side, one of said folded sheets being the outermost sheet with all the remaining sheets being nested within said outermost sheet, said outermost sheet and an innermost sheet being wider in the dimension measured normal to said fold lines than the other narrower sheets whereby the innermost and outermost of said sheets form bindery laps along their side edges opposite said aligned side edges.

* * * * *